US005535671A

United States Patent [19]

Kanno

[11] Patent Number: 5,535,671

[45] Date of Patent: Jul. 16, 1996

[54] STENCIL DUPLICATING MACHINE APPLYING UNIFORM TENSION TO A STENCIL

[75] Inventor: Hiroshi Kanno, Shiroishi, Japan

[73] Assignee: Tohoku Ricoh Co., Ltd., Miyagi, Japan

[21] Appl. No.: 253,132

[22] Filed: Jun. 2, 1994

[30] Foreign Application Priority Data

Jun. 2, 1993 [JP] Japan ..... 5-132164
Apr. 13, 1994 [JP] Japan ..... 6-075139

[51] Int. Cl.[6] ..... B41L 13/06

[52] U.S. Cl. ..... 101/116; 101/128.4

[58] Field of Search ..... 101/114, 116, 101/117, 118, 119, 121.122, 128, 128.1, 127.1, 128.21, 128.4, 129, 477, 136, 141, 142, 415.1; 355/213

[56] References Cited

U.S. PATENT DOCUMENTS 3,491,684 1/1970 Borinsky ..... 101/451
4,044,670 8/1977 Maynard ..... 101/128.1
4,085,671 4/1978 Gates et al. ..... 101/116
4,231,652 11/1980 Moser et al. ..... 355/213
5,048,416 9/1991 Iijima ..... 101/122

FOREIGN PATENT DOCUMENTS 11284 1/1986 Japan ..... 101/114
62-73987 4/1987 Japan .
73987 4/1987 Japan ..... 101/116
73988 4/1987 Japan ..... 101/116
109678 5/1987 Japan ..... 101/116

*Primary Examiner*—Stephen Funk
*Attorney, Agent, or Firm*—Oblon, Spivak, McClelland, Maier & Neustadt

[57] ABSTRACT

In a stencil duplicating machine, uniform tension is applied to a stencil so that a new stencil is wound around a printing drum and a used stencil is taken up on a stencil take-up spool without being creased or stretched. A quantity of the stencil bearing an original image can be saved.

10 Claims, 10 Drawing Sheets

STENCIL DUPLICATING MACHINE APPLYING UNIFORM TENSION TO A STENCIL

FIELD OF THE INVENTION

This invention relates to a stencil duplicating machine of the type having a stencil making section and a printing section in an integrated assembly. The stencil making section perforates a pattern of an original image on a stencil by a thermal perforation process.

DESCRIPTION OF THE RELATED ART

In a conventional stencil duplicating machine including a stencil making section, a stencil is paid out from a rotatable stencil web, and is pressed to a thermal head on a platen roller to have a pattern of an original image perforated thereon. Then, the perforated stencil (called "stencil" hereinafter) is wound around the outer circumferential surface of a rotary cylindrical drum (called "printing drum") with its leading edge gripped by a clamp on the printing drum, and is cut to a predetermined length. After printing, a used stencil is peeled off from the printing drum, and is dumped into a used stencil box. In other words, the stencil is cut to the predetermined length from the stencil web each time a new stencil is perforated with a pattern indicative of each original image. Then, each used stencil is discharged.

Such a conventional stencil web comprises a porous and flexible substrate such as Japanese paper and a thermoplastic resin film adhered to the substrate. However, a stencil substantially made only of a very thin thermoplastic resin film has become popular for improving the quality of images and reducing cost thereof. Such a stencil is so soft that it is very difficult to convey in a conventional stencil duplicating machine in which the stencil is conveyed by using the rigidity thereof.

To overcome the foregoing problem, Japanese Patent Publication Hei 5-70595 proposes a stencil duplicating machine, which comprises a printing drum including an ink supply therein, and a stencil feed/take-up section disposed near the printing drum. A stencil is wrapped on the printing drum for the printing process. The stencil feed/take-up section includes a stencil web, a stencil take-up unit, and a stencil perforating unit (i.e. a thermal head).

The foregoing stencil duplicating machines are prone to problems as described below.

(1) In the stencil feed/take-up section, a stencil take-up spool is rotated by a drive force from an associated motor. The printing drum follows the rotation of the stencil take-up spool. As the stencil take-up spool rotates to take up a used stencil from the rotating printing drum, a fresh stencil is paid out from the stencil web and is perforated by the thermal head. The stencil take-up spool has to take up the inked and used stencil which is thicker than the fresh perforated stencil. The more used stencils that are wound on the stencil take-up spool, the more variable the peripheral velocity of the stencil take-up spool becomes. Further, the tension applied to the used stencil acts on the fresh stencil portion, which would stretch the fresh stencil portion. Still further, a platen roller and a thermal head holding the stencil therebetween may prevent smooth paying-out of the fresh stencil portion. A mechanism such as a sheet feeding mechanism is also operated under the foregoing state. Therefore, it seems very difficult to feed the stencil reliably.

(2) The stencil tends to be creased when it is thermally perforated by the thermal head.

(3) The foregoing reference does not describe anything with respect to a stencil residual sensor. When such a sensor is mounted in the stencil duplicating machine, a connector therefor will be required and frequently connected and disconnected, which would make the sensor less reliable. Further, the stencil duplicating machine would be expensive due to the addition of a mechanism for connecting and disconnecting the connector.

(4) During the printing process, the printing drum is rotated by force transmitted from a drive mechanism. The stencil feed/take-up unit holding the leading and trailing edges of the stencil on the printing drum is rotated by a rotational force which is transmitted by the tension of the stencil. In this driving method, the stencil may be broken when an excess force is applied thereto. The stencil may shift its position on the printing drum when it is pressed by a press roller. Such a phenomenon might promote production of poorly printed images as the number of prints increases. Further, the stencil feed/take-up unit might be out of phase with a recessed portion of the press roller, and strike the other portion of the press roller.

(5) The printing drum is directly operated by the driving mechanism which also serves for other mechanisms in the stencil duplicating machine. Therefore, a rotational phase of the printing drum depends upon factors such as the operation timing of a sheet feeding mechanism and printing pressure. Therefore, the printing drum has, only on a particular area thereof, a porous portion through which ink oozes out during the printing process.

SUMMARY OF THE INVENTION

It is therefore an object of the invention to overcome the foregoing problems and to provide a stencil duplicating machine in which uniform tension is applied so as to wrap a stencil around a printing drum and take up a used stencil onto a stencil take-up spool from the printing drum. Thus, the stencil duplicating machine can protect the stencil against problems such as wrinkles or stretching. A further object of the invention is to provide a stencil duplicating machine which can reduce an amount of the stencil wasted.

According to the invention there is provided a stencil duplicating machine comprising: a printing drum for supporting on an outer circumferential surface thereof a thermal perforation type stencil and being rotatable around a center shaft with the stencil wound thereon; an ink supply for supplying ink to an inner circumferential surface of the printing drum; a stencil web support for supporting a stencil web from which the stencil is paid out to the printing drum; a stencil take-up spool support for supporting a stencil take-up spool around which the stencil is taken up from the printing drum; a platen roller for conveying the stencil paid out from the stencil web, the platen roller being located near the stencil web support means; a thermal head supported by a main body, the thermal head being movable between a stencil-making position, where it is in contact with the platen roller via the stencil during a stencil making process, and a non-stencil-making position, where it is positioned away from the platen roller; a thermal head moving mechanism for selectively moving the thermal head between the stencil-making position and the non-stencil-making position; a stencil feed/take-up unit for supporting the stencil web support means, the stencil take-up spool support means and the platen roller, the stencil feed/take-up unit being freely rotatable around the center shaft with respect to the printing drum; a driving mechanism for rotating the printing drum and/or the stencil feed/take-up unit around the center shaft; a brake member for stopping the stencil feed/take-up unit at a position corresponding to the stencil-making position with respect to the main body during the stencil take-up and making processes; a platen roller driving mechanism for selectively driving the platen roller; and a torque limiting member for transmitting a rotational force of the platen roller to the stencil take-up spool.

BRIEF DESCRIPTION OF THE DRAWING

These and other aspects, objects, features and advantages of the invention will be more clearly understood and appreciated from a review of the following detailed description of the preferred embodiment and appended claims, and by reference to the accompanying drawings in which:

FIG. 7(*b*) shows a lengthwise relationship between the printing drum and the stencil.

FIG. 8(*b*) is a view similar to FIG. 7(b) but showing the lengthwise relationship between the printing drum and the stencil in the preferred embodiment.

DESCRIPTION OF THE PREFERRED EMBODIMENT

Figure 1:
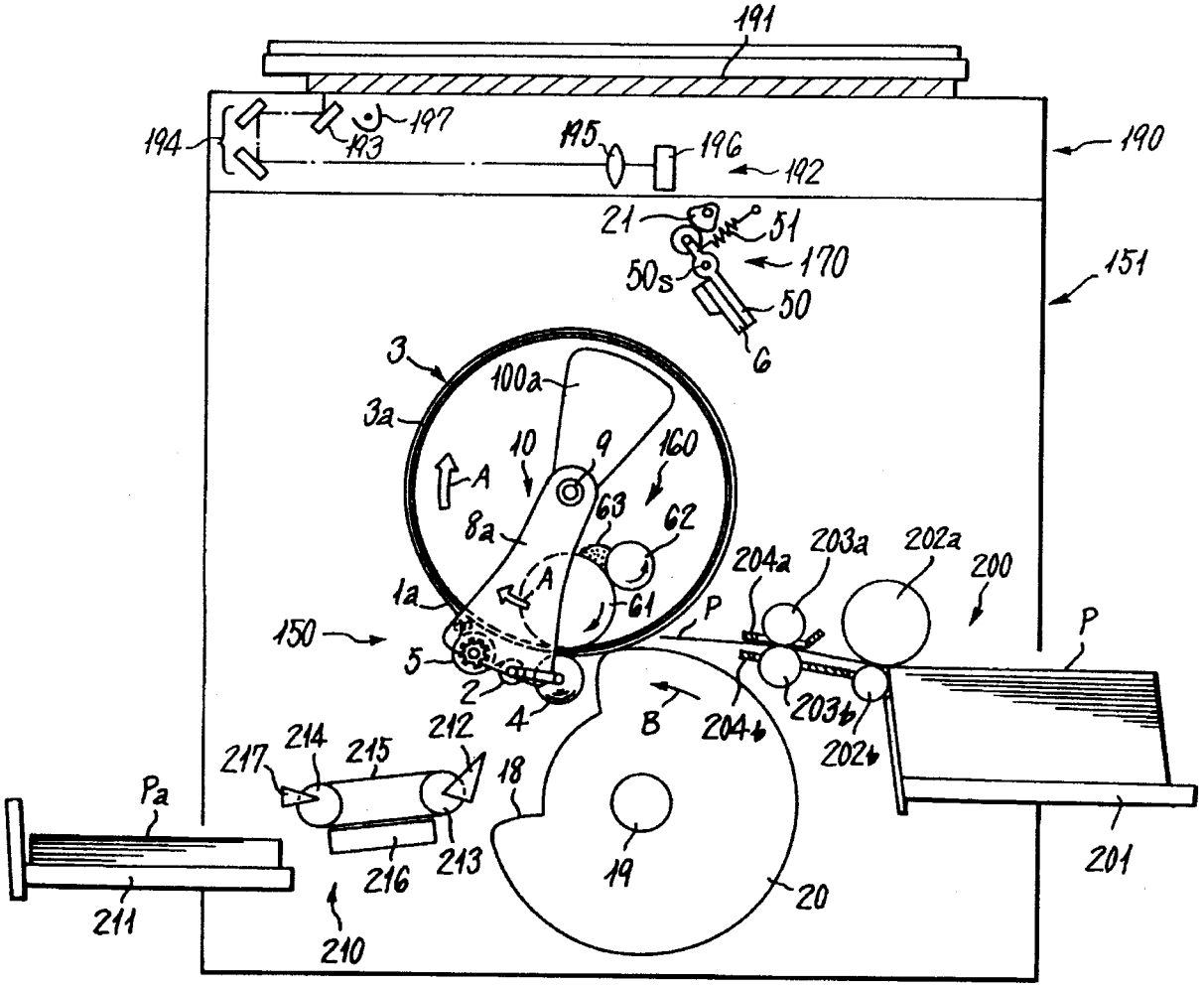
FIG. 1 is a schematic view showing the main part of a stencil duplicating machine according to a preferred embodiment of the invention.

Referring to FIG. 1, a stencil duplicating machine will be described according to an embodiment of the invention. The stencil duplicating machine comprises a main body 151, an original reader 190 for reading an original (not shown) placed on an original receptacle 191, a stencil making/printing section 150, a sheet feeding section 200, and a printed sheet receiving section 210. The stencil duplicating section 150 is housed in the main body 151 at the upper and center areas thereof. The sheet feeding section 200 is positioned at a lower right area in the main body 151, and feeds print sheets P toward the lower part of the printing drum 3 from a sheet tray 201. The printed sheet receiving section 210 is positioned opposite to the sheet feeding section 200, and includes a discharge tray 211 for receiving the printed sheets Pa.

The original reader 190 is a well-known original scanning optical system, which includes a scanning mirror 193, a pair of reflecting mirrors 194 moving at half the speed of the scanning mirror 193, and a lamp 197 which is movable together with a scanning mirror 193, an imaging lens 195, and a CCD 196.

Figure 2:
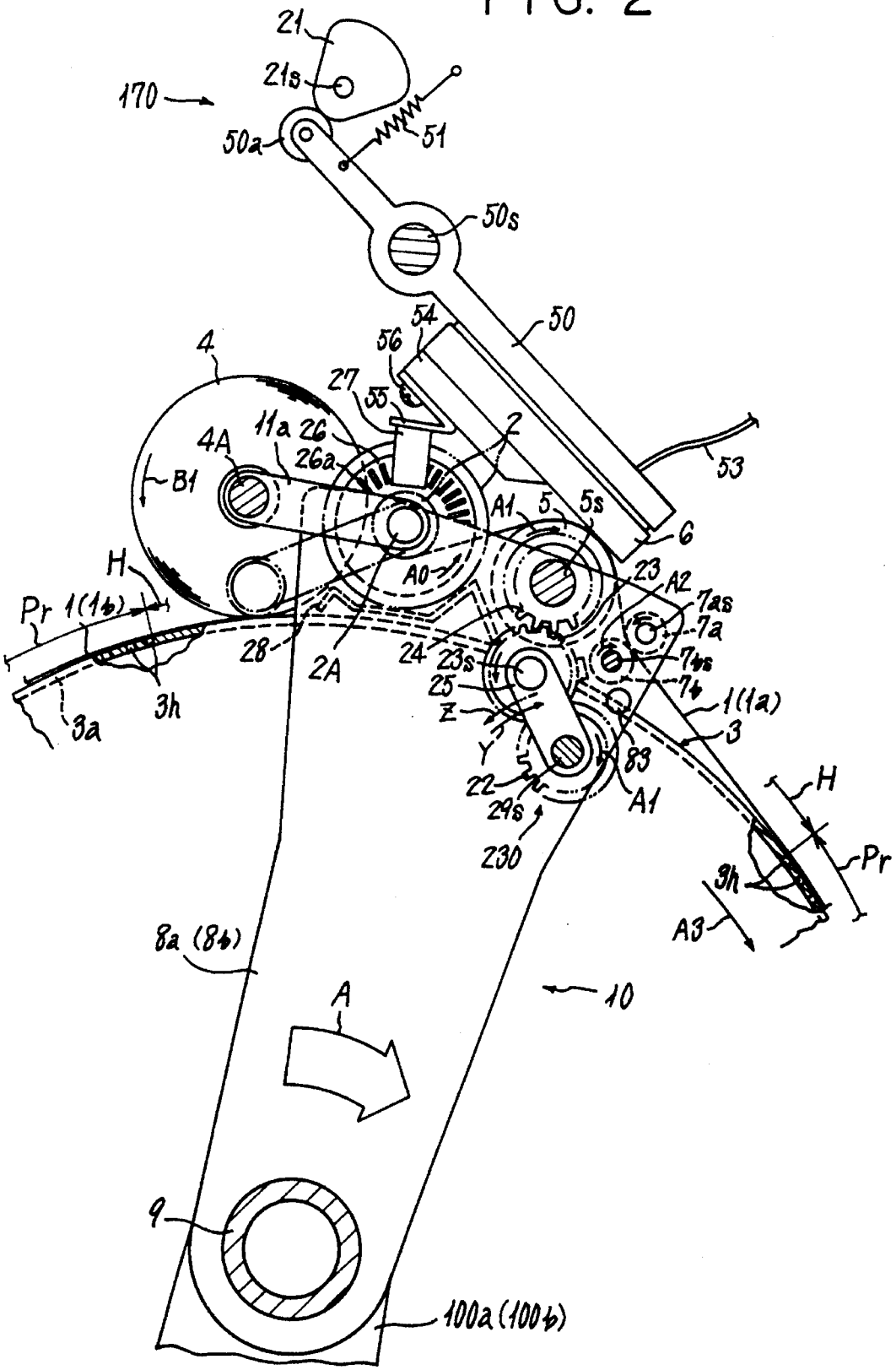
FIG. 2 is a side elevation showing the main part of the stencil duplicating machine of FIG. 1.
Figure 3:
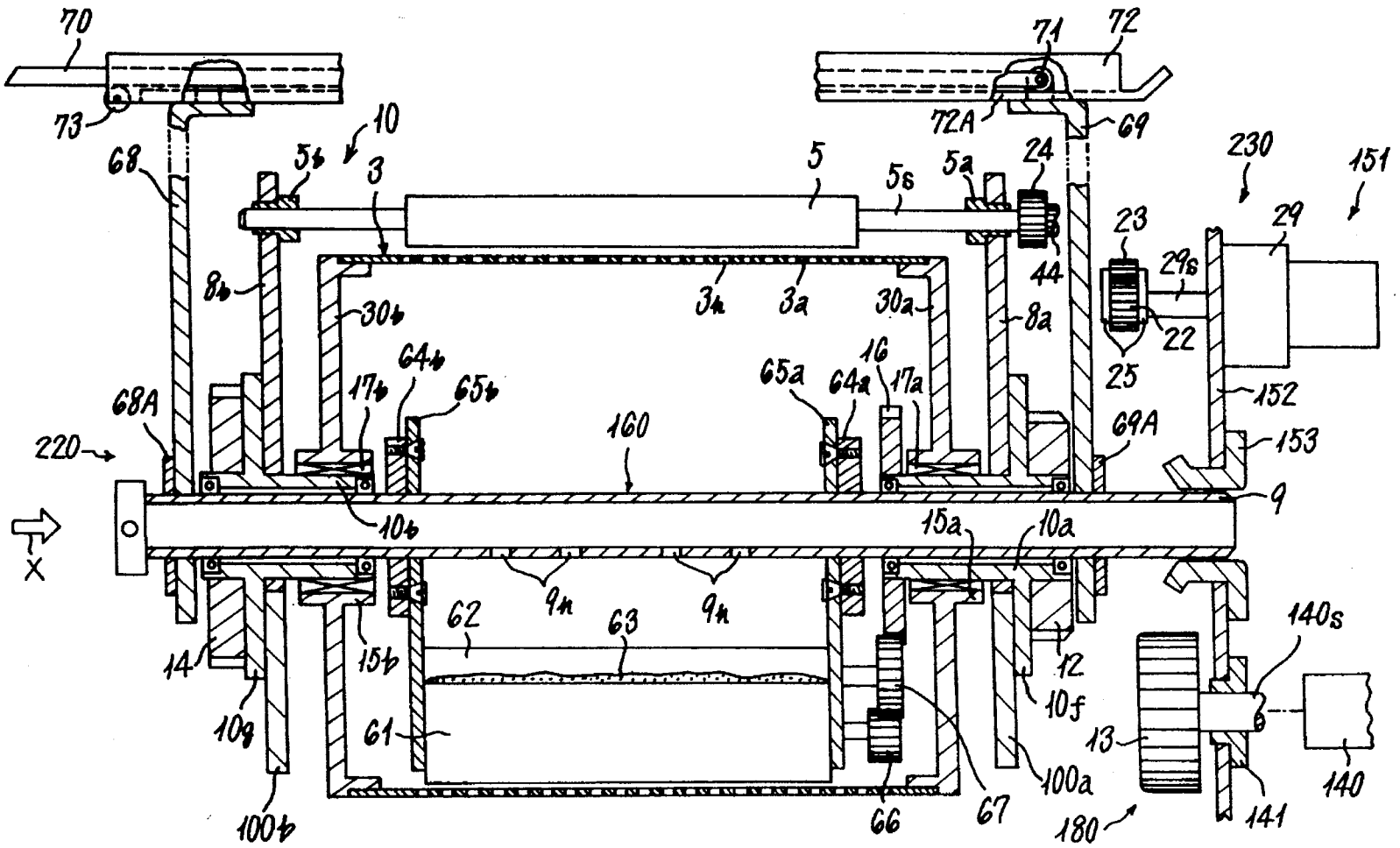
FIG. 3 is a front elevation showing the main part of the stencil duplicating machine of FIG. 1.

As shown in FIGS. 1, 2 and 3, the stencil making/printing section 150 includes a drum unit 220, a platen roller 5, a thermal head 6, a thermal head moving mechanism 170, a driving mechanism, a brake member, a platen roller driving mechanism, and a torque limiting member for transmitting rotational force of the platen roller 5 to the stencil take-up spool 4. The drum unit 220 includes the printing drum 3, an ink supply 160, a support for a stencil web 2, a support for a stencil take-up spool 4 and a stencil feed/take-up unit 10.

Referring to FIG. 3, the drum unit 220 further includes the center shaft 9, a front frame 68, a rear frame 69 and a support member 70, and is freely attachable and detachable from the main body 151.

The stencil feed/take-up unit 10 mainly includes the stencil web 2, support for the stencil web 2, support 4H for the stencil take-up spool 4, the platen roller 5, a pair of tension rollers 7*a* and 7*b*, a pair of stencil feed/take-up arms 8*a* and 8*b*, a pair of drum bearings 10*a* and 10*b*, a drum gear 12, a gear 16 for the ink supply 160, a gear 14 for an ink pump, and a linkage 28. This unit will be described in detail later.

The printing drum 3 is movable in the direction A around a center shaft 9, and carries a stencil 1 thereon. The stencil 1 from the stencil web 2 is wound around the printing drum 3 via the platen roller 5 which is positioned near the stencil web 2. After printing, the used stencil is taken up around the stencil take-up spool 4.

The thermal head 6 is supported at an upper part of the main body 151 and comes into contact with the platen roller 5 during the stencil perforating process. The thermal head moving mechanism 170 selectively moves the thermal head 6 between a perforating position, where the thermal head 6 comes into contact with the platen roller 5 to perforate a pattern of an original image on the stencil, and a non-perforating position spaced away from the platen roller 5.

The stencil feed/take-up unit 10 provides the support for the stencil web 2, the support for the stencil take-up spool 4 and the platen roller 5, and is rotatable relative to the printing drum 3.

The driving mechanism rotates the printing drum 3 and/or the stencil feed/take-up unit 10 around the center shaft 9. The brake member stops the stencil feeding/take-up unit 10 at a position corresponding to the stencil perforating position relative to the main body 151.

The platen roller driving mechanism selectively actuates the platen roller 5.

Figure 4:
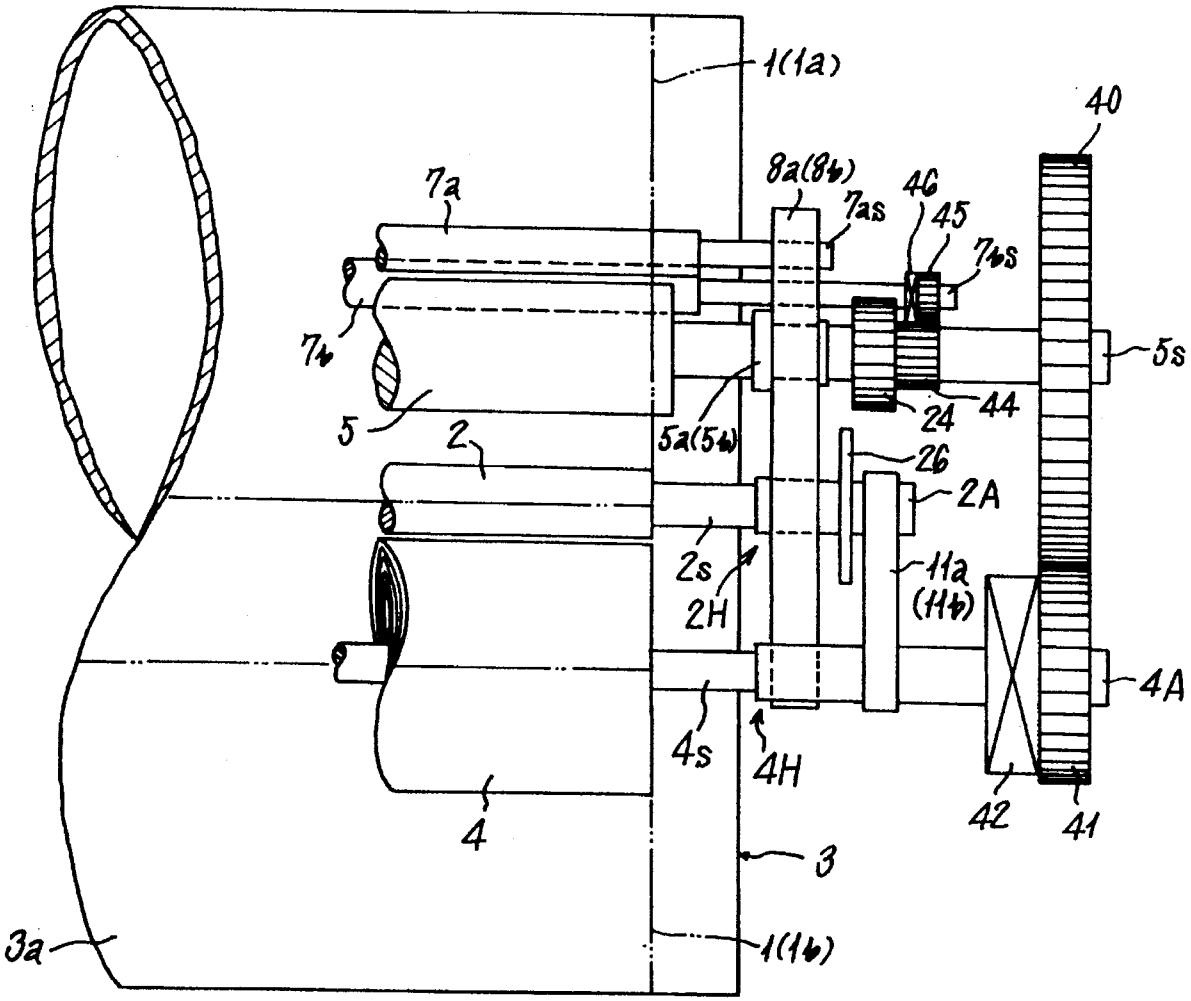
FIG. 4 is a plan view of the main part shown in FIG. 2.

FIGS. 1, 2 and 4 show that the stencil web 2 becomes thinner and the stencil take-up spool 4 becomes thicker with a used stencil wrapped thereon. A drum gear 12, a second gear 44, a flange 10*f*, etc. which will be described later are omitted in FIGS. 1 and 2 for simplification.

As shown in FIGS. 2 and 3, the printing drum 3 extends axially along the center shaft 9, and has a double layer structure, which includes a metallic cylinder 3*a* and a mesh screen (not shown) wrapped around the cylinder 3*a*. The metallic cylinder 3*a* has a printing area Pr where minute pores 3*h* are formed to let ink pass through, and a non-printing area H through which no ink passes. The printing area Pr occupies substantially four fifths of the cylinder 3*a*. Non-printing areas are also formed along the side edges of the printing drum 3 as shown in FIG. 3.

The printing drum 3 has a pair of flanges 30*a* and 30*b* at the opposite ends thereof. A pair of drum bearings 10*a* and 10*b* including roller bearings are rotatably disposed between center areas of the flanges 30*a* and 30*b* and the center shaft 9. The drum bearings 10*a* and 10*b* have flanges 10*f* and 10*g* as integral parts, respectively.

A pair of bearings 15*a* and 15*b* are disposed between the center areas of the flanges 30*a* and 30*b* and outer circumferential surfaces of the drum bearings 10*a* and 10*b*. The bearings 15*a* and 15*b* include one-way clutches 17*a* and 17*b*. During the printing process, the one-way clutches 17*a* and 17*b* are connectable in the direction to transmit the rotational force of the driving mechanism toward the printing drum 3 via the stencil feed/take-up unit 10. Conversely, during the stencil making and taking-up processes, the stencil take-up spool 4 rotates, so that these clutches 17*a* and 17*b* become free in the direction in which the printing drum 3 rotates following the stencil take-up spool 4. Therefore, during the stencil making and taking-up processes, the rotation of the stencil take-up spool 4 causes the stencil 1, sticking onto the printing drum 3 because of the ink, to be peeled off from the outer surfaces of the printing drum 3, which makes the printing drum 3 rotatable in the direction in which the stencil 1 is taken up. Further, during the printing process, the printing drum 3 is rotated by the driving mechanism in the direction A.

The one-way clutches 17*a* and 17*b* have any well-known structure.

The drum gear 12 is attached to an outer end of the drum bearing 10*a* next to the flange 10*f*, and a gear 16 for the ink supply 160 is disposed at the opposite inner end of the drum bearing 10*a*. The drum gear 12 and the gear 16 are integral with the drum bearing 10*a*. The gear 14 for an ink pump is integrally attached to an outer end of the drum bearing 10*b* next to the flange 10*g*. The gear 14 is coupled to an ink supply pump (not shown) so as to supply ink to an ink pipe 9, i.e. the center shaft 9, from the ink supply pump. Therefore, when the stencil feed/take-up unit 10 is rotated by the driving mechanism, the ink supply pump follows the rotation of the unit 10, thereby supplying ink to the ink pipe 9.

Referring to FIGS. 1 and 3, the ink supply 160 includes an ink supply roller 61, a doctor roller 62, and the ink pipe 9. The ink supply roller 61 supplies ink to an inner surface of the cylinder 3*a* of the printing drum 3. The doctor roller 62 is positioned in parallel to the ink supply roller 61 with a minute space kept therebetween, and forms an ink reservoir 63 relative to the ink supply roller 61. The ink pipe 9 transfers ink to the ink reservoir 63 via an opening 9*h* thereof.

Referring to FIG. 3, annular stops 64*a* and 64*b* are fixedly attached on the outer surface of the ink pipe 9 near the drum bearings 10*a* and 10*b*. These stops 64*a* and 64*b* are coupled to a pair of support plates 65*a* and 65*b* by means of screws. The ink supply roller 61 is rotatably disposed at a lower position between the support plates 65*a* and 65*b*. The ink supply roller 61 is supported by a shaft having a roller actuating gear 66 at one end thereof. Slightly above the ink supply roller 61, the doctor roller 62 is supported by a shaft between the support plates 65*a* and 65*b*. An idler gear 67 is rotatably supported on the support frame 65*a* by a shaft. The idler gear 67 is in engagement with the gear 66 and an ink supply gear 16. The drum gear 12 is selectively engaged with a drum actuating gear 13 constituting the driving mechanism on the main body 151, as will be described later. Thus, the rotational force of the drum actuating gear 13 is transmitted to the drum shaft (bearing) 10*a* and the ink supply gear 16, so that the ink supply roller 61 is rotated clockwise (shown by an arrow A in FIGS. 1 and 2) at about half the peripheral velocity of the printing drum 3 in synchronization with the printing drum 3.

As shown in FIG. 3, the center shaft 9 has one end received in a bearing 153 on a side plate 152 which is coupled to the main body 151. The center shaft 9 is detachably supported by the bearing 153. Annular fixtures 68A and 69A are attached substantially at the opposite ends of the center shaft 9. The front and rear frames 68 and 69 are fastened by screws to inner sides of the annular fixtures 68A and 69A, respectively. The center shaft 9 passes through the front and rear frames 68 and 69. The tops of the front and rear frames 68 and 69 are fixed to the long support member 70. A pair of rollers 71 are rotatably supported by a shaft on the support member 70. The support member 70 is detachably held by a holding member 72 which is attached to the main body 151. The holding member 72 is in the shape of an inverted E-channel, and extends in parallel to the printing drum 3, and has a pair of rollers 73 at one end thereof.

The drum unit 220 is guided by the rollers 73 into the holding member 72 with the rollers 71 of the support member 70 serving as a leading part, and is withdrawn from the holding member 72. In this state, the rollers 71 move on a pair of rails 72A extending inside the holding member 72. When the drum unit 220 is inserted, the center shaft 9 is received and supported in the bearing 153 at one end. The drum unit 220 is withdrawn in the manner opposite to the foregoing procedure.

Referring to FIG. 3, the drive mechanism 180 mainly includes a drive unit 140, an output shaft 140*s*, and the drum actuating gear 13.

The drive unit 140 is coupled to the output shaft 140*s*, and is fixedly mounted on the main body 151. The drum actuating gear 13 is attached to one end of the output shaft 140*s*, and engages with the drum gear 12 when the drum unit 220 is installed in the direction X and the center shaft 9 is received in the bearing 153. A bearing 141 is attached to the side plate 152 below the bearing 153. The output shaft 140*s* is rotatably supported via the bearing 141. The drive unit 140 includes a motor (not shown) and a transmission mechanism (not shown). The drive mechanism 180 determines the timing for a sheet feeder 200 to feed print sheets P, the timing for the press roller 20 to come into contact with the printing drum 3 during the printing process, and so on.

As shown in FIG. 1, the press roller 20 is located below the printing drum 3 at a position opposite to the ink supply roller 61. The press roller 20 is rotatable around a shaft 19 in the direction B (i.e. counterclockwise). The shaft 19 is connected to a press roller driving mechanism (not shown). The press roller 20 comes into contact with the stencil 1 wrapped on the outer surface of the printing drum 3. Further, the press roller 20 has a recessed area 18 so that it does not interfere with the stencil feed/take-up unit 10 which radially projects from the outer surface of the printing drum 3. The press roller 20 is rotated in timed relation with the stencil feed/take-up unit 10 and the sheet feed unit 200 so that the recessed area 18 of the press roller 20 matches the stencil feed/take-up unit 10, i.e. the press roller 20, and units 10 and 200 are rotated or driven synchronously with one another. Since the press roller 20 is similar to the press roller 4 disclosed in Japanese Utility Model Publication No. Sho 55-23867, for example, it will not be described here in detail.

Referring to FIGS. 1 to 3, a pair of stencil feed/take-up arms 8*a* and 8*b* are fixedly attached to inner surfaces of the flanges 10*f* and 10*g*. Balancing weights 100*a* and 100*b* are attached to the flanges 10*f* and 10*g* at positions opposite to the stencil feed/take-up arms 8*a* and 8*b* around the center shaft 9. The balancing weights 100*a* and 100*b* are made of a material having a relatively large specific gravity, and are located so that they do not interfere with the rotating stencil feed/take-up unit 10. The balancing weights 100*a* and 100*b* are sectorial, and are designed to have a weight and size so as to balance with the rotational moment of the stencil feed/take-up unit 10 with respect to the center shaft 9. In the printing process (to be described later), the stencil feed/take-up unit 10 and the printing drum 3 rotate at a high speed in unison. The balancing weights 100*a* and 100*b* allow a smooth rotation of the unit 10 and the printing drum 3 with little load variation applied thereto, thereby assuring a reliable printing operation at a high speed.

Referring to FIGS. 1, 2, 4 and 6, the stencil 1 is made substantially only of a very thin thermoplastic resin film, is 7μm thick, and is paid out from the stencil web 2 received on a core 2*s*. An antistatic agent is coated on the stencil 1 on a side thereof coming into contact with the thermal head 6. The material of the stencil 1 is not limited to that described above but may be films such as a thermoplastic resin film including a minute amount of antistatic agent, or a thermoplastic resin film having at least one overcoating layer on a front or rear side.

When it is full, the stencil web 2 is remarkably small in size compared with conventional stencil webs. However, the length of a stencil thereon is equal to that of conventional stencil webs. The core 2*s* is made of a synthetic resin pipe, for example, and carries the stencil web 2 thereon. One end of the stencil 1 is stuck onto the core 2*s*. The core 2*s* is longer than the stencil web 2, and has a pair of slits 2*a* and 2*b* at the opposite ends thereof.

A stencil web support 2H mainly includes a coupling shaft 2A, a coupling slide shaft 2B, and two bearings (not shown), which will be described later.

Figure 6:
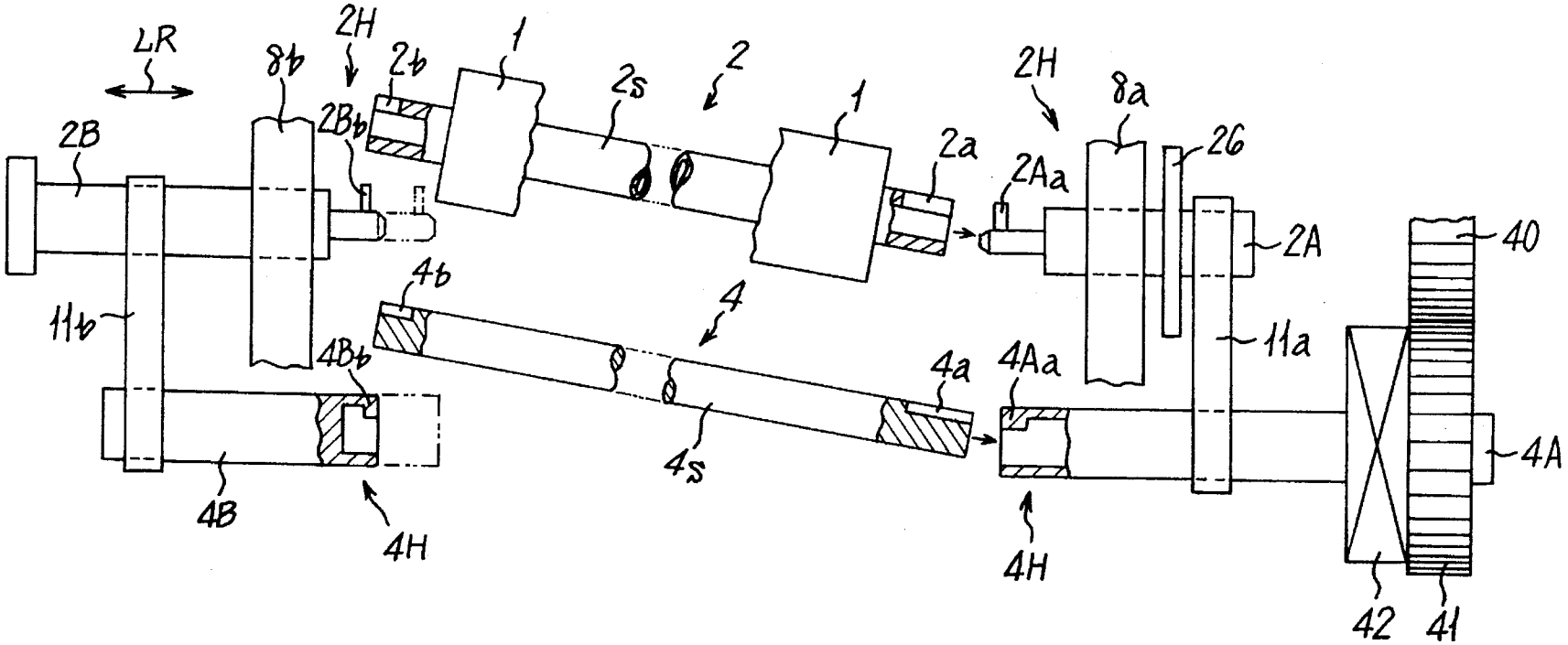
FIG. 6 is a plan view, partly in cross section, of supports for a stencil web and a stencil take-up spool.

Referring to FIG. 2, the coupling shaft 2A is rotatably connected to a free end of the stencil feed/take-up arm 8*a* via a bearing (not shown). The coupling shaft 2A includes a projection 2A*a*, which fits into the slit 2*a* at one end of the core 2*s* of the stencil web 2. The coupling shaft 2A is rotatable in a direction shown by an arrow A0 (FIG. 2). On the other hand, the coupling slide shaft 2B is rotatably connected to a free end of the stencil feed/take-up arm 8*b* via a bearing (not shown). The coupling slide shaft 2B includes a projection 2B*b*, which fits into the slit 2*b* at the other end of the core 2*s* of the stencil web 2. The shaft 2B is rotatable not only in the direction AO but is slidable in the direction LR as shown in FIG. 6. The coupling shaft 2A includes a disc 26, which has a plurality of radial slits 26*a* and serves as a sensor for detecting a rotational speed of the stencil web 2.

Spring clutches (not shown) are disposed near the bearings on the stencil feed/take-up arms 8*a* and 8*b* so as to apply a preset braking force to the stencil web 2 via the coupling shafts 2A and 2B. Thus, a predetermined tension is continuously applied to the stencil 1 paid out from the stencil web 2, thereby preventing the stencil 1 from becoming loose and being creased.

Although two spring clutches are used in this embodiment, only one spring clutch need be attached, to either coupling shaft 2A or 2B. Alternatively, an elastic member made of rubber may be used in place of the spring clutch so as to apply load to the coupling shaft 2A and/or the coupling slide shaft 2B.

Referring to FIGS. 1, 2, 3 and 4, the platen roller 5 is rotatably supported by the free ends of the stencil feed/take-up arms 8*a* and 8*b* via an integral shaft 5*s* thereof. Specifically, the shaft 5*s* is received at its opposite ends in bearings 5*a* and 5*b* which are at the free ends of the stencil feed/take-up arms 8*a* and 8*b*. The stencil 1 paid out from the stencil web 2 passes over part of the platen roller 5 which is rotatable in the direction A1 (refer to FIG. 2). The platen roller 5 is made of antistatic material including synthetic rubber whose hardness is A30° according to JIS (Japanese Industrial Standard), and extends axially in parallel to the center shaft 9 of the printing drum 3. The platen roller 5 includes a gear 24 at one end of the shaft 5*s*. The gear 24 has a second small-diameter gear 44 as an integral part as shown in FIGS. 3 and 4.

The platen roller 5 is actuated by a platen roller driving mechanism 230, which is supported on the main body 151, and includes a pulse motor 29, a shaft 29*s*, a pair of arms 25, and gears 22 and 23 as will be described later.

As shown in FIG. 3, the pulse motor 29 is disposed at an upper part of the side plate 152 coupled to the main body 151. The pulse motor 29 includes a rotary shaft 29*s*. A pulse motor gear 22 is rotatably supported on the rotary shaft 29*s* between bases of a pair of confronting arms 25. The gear 23 is positioned at the free end of the pair of arms 25, and is rotatably supported by these arms 25 via a shaft 23*s*. The gear 23 is continuously in engagement with the gear 22 and selectively comes into engagement with the platen roller gear 24.

A spring clutch (not shown) is disposed near a bearing for the shaft 23*s* on the arms 25 so as to apply a brake force to the shaft 23*s*. In other words, a light brake load is applied to the gear 23. An angle, which is formed by a half-line connecting the shafts 5*s* and 23*s* and a half-line connecting the shafts 23*s* and 29*s*, is set to be substantially a right angle or an obtuse angle.

When the platen roller 5 and the pulse motor 29 rotate in the direction A1 to start the stencil making process, the gear 23 coupled to the arm pair 25 turns slightly in the direction Y (shown by a solid line) around the shaft 29*s* in response to a rotational moment of the gear 22, so that the platen roller gear 24 and the gear 23 engage with each other since the rotational force of the pulse motor 29 is transmitted to the platen roller 5. On the other hand, when the stencil making process is completed, the pulse motor 29 turns reversely (i.e. counterclockwise), and the gear 23 coupled to the pair of arms 25 turns slightly around the shaft 29*s* in the direction Z shown by a dashed line. Thus, the gears 24 and 23 disengage from each other, so that the arm pair 25 are held on the side plate 152 by a stop (not shown).

Figure 5:
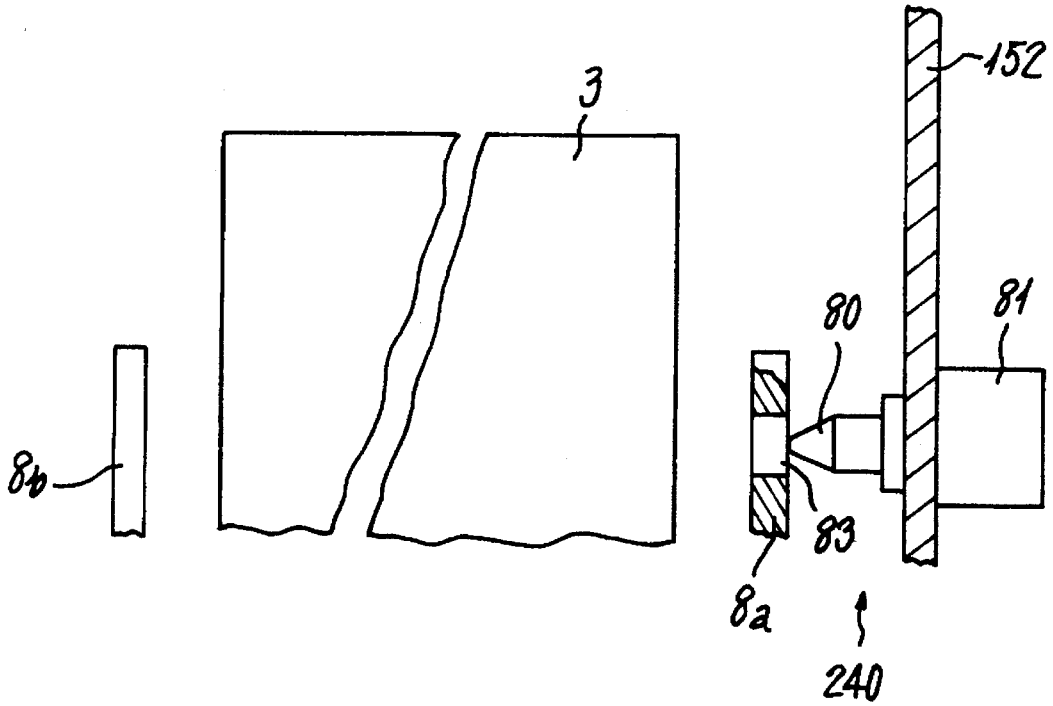
FIG. 5 is a view, partly in cross section, showing the main part of a brake member of a stencil feed/take-up unit.

Referring to FIG. 5, the brake member 240 includes a guide pin 80 and a solenoid 81 of plunger projecting type. The guide pin 80 can project in a direction parallel to the center shaft 9 of the printing drum 3, and is attached on the side plate 152 of the main body 151. When projecting, the pin 80 fits into a hole 83 on the free end of the stencil feed/take-up arm 8*a*. Alternatively, the brake member 240 may be disposed beside the stencil feed/take-up arms 8*a* and 8*b*, so that the stencil feed/take-up unit 10 may be stopped at the position corresponding to the stencil making position with respect to the main body 151 as shown in FIG. 2.

As shown in FIGS. 1, 2, 4 and 6, the shaft 4*s* of the stencil take-up spool 4 has a slit (not shown), into which a leading edge of the stencil 1 is received. The shaft 4*s* has slits 4*a* and 4*b* at the opposite ends thereof. The shaft 4*s* is a synthetic resin rod, for example.

Referring to FIG. 6, the support 4H for the stencil take-up spool 4 mainly includes a coupling shaft 4A, a coupling slide shaft 4B, and two bearings (not shown). One end of the coupling shaft 4A is cylindrical. A projection 4A*a* is formed on an inner wall of the cylindrical portion of the shaft 4A, and engages with the slit 4*a* of the shaft 4*s* of the stencil take-up spool 4. One end of the coupling slide shaft 4B is also cylindrical. A projection 4B*b* is formed on an inner wall of the cylindrical portion of the shaft 4B, and engages with the slit 4*b* of the stencil take-up spool 4. Thus, the stencil take-up spool 4 is supported by the coupling shafts 4A and 4B, so that the stencil take-up spool 4 is positioned in parallel to the shaft 5*s* of the platen roller 5 and the core 2*s* of the stencil web 2.

The coupling shaft 4A is rotatably supported, at its substantially center portion, by one end of an arm 11*a* via a bearing (not shown). The arm 11*a* is outside the stencil feed/take-up arm 8*a*. The coupling slide shaft 4B is rotatably supported, at an outer end thereof, by one end of an arm 11*b* via a bearing (not shown). The arm 11*b* is positioned outside the stencil feed/take-up arm 8*b*. The coupling shaft 2A is rotatably supported, at an outer end thereof, by the other end of the arm 11*a*. Further, the coupling slide shaft 2B is rotatably supported, at a substantially center portion thereof, by the other end of the arm 11*b*.

A torsion coil spring (not shown) is disposed between the coupling shaft 2A and the arm 11*a*, and between the coupling slide shaft 2B and the arm 11*b* so that these coil springs push the stencil take-up spool 4 to the outer surface of the printing drum 3. The stencil take-up spool 4 is in continuous contact with the outer surface of the printing drum 3 with a predetermined pressure. Even when the stencil take-up spool 4 becomes thicker with used stencil portions, the stencil 1 is continuously in contact with the outer surface of the printing drum 3 with a predetermined pressure, which means that the used stencil 1*b* is peeled off from the printing drum 3 at the same position thereof. In FIG. 2, dashed lines show the stencil web 2, the arms 11*a* and 11*b*, and the stencil take-up spool 4 are in an initial state where a new stencil web 2 is loaded into the drum unit 220.

Referring to FIG. 4, a first gear 40 is fixed to one end of the shaft 5*s* of the platen roller 5. A gear 41 is fixedly attached to one end of the coupling shaft 4A. The gear 41 serves for the stencil take-up spool 4, and is in continuous engagement with the first gear 40 via a friction clutch 42. The clutch 42 is a spring clutch which functions as a torque limiter.

Referring to FIG. 3, the drum unit 220 is loaded into the main body 151 in the direction X. When the pulse motor 29 operates, the platen roller driving gear 23 (for the platen roller driving mechanism 230) engages with the platen roller gear 24 (for the platen roller 5). The first gear 40 is in engagement with the gear 41, so that the rotational force of the pulse motor 29 is transmitted to the stencil take-up spool 4 via the friction clutch 42. Thus, the stencil take-up spool 4 is rotated in the direction B1 (shown in FIG. 2). A used stencil 1*b*, being held around the printing drum 3 by viscous ink, has the predetermined tension applied thereto by the spring clutch 42, and is peeled off from the printing drum 3 as the stencil take-up spool 4 rotates. The peeled stencil lb is taken up onto the stencil take-up spool 4. Although it becomes thicker with used stencils 1*b*, the stencil take-up spool 4 rotates at a constant speed in response to the operation of the friction clutch 42. In other words, the stencil take-up spool 4 rotates at the same speed as the platen roller 5.

As shown in FIGS. 2 and 4, a pair of tension rollers 7*a* and 7*b* are positioned downstream of the platen roller 5 in the stencil feeding direction. These tension rollers 7*a* and 7*b* are in pressure contact with each other, and pass the stencil 1 therethrough toward the printing drum 3. The tension rollers 7*a* and 7*b* are rotatably supported via their shafts 7*as* and 7*bs* by bearings (not shown) which are on the stencil take-up arms 8*a* and 8*b*, respectively. A tension roller gear 45 is fixed to one end of the shaft 7*bs* via a friction clutch 46 as a torque limiter for the tension rollers 7*a* and 7*b*. An idler gear (not shown) is disposed between a second gear 44 and the tension roller gear 45, and is continuously engaged with the rollers 44 and 45. The idler gear is rotatably supported by a shaft (not shown) to the stencil take-up arm 8*a*.

During the stencil making process, the tension roller 7*b* is rotated in the direction A2 via the friction clutch 46 since the idler gear is in engagement with the gear 45. Operation of the friction clutch 46 applies the predetermined tension to the stencil 1*a* which has a thermally perforated pattern of an original image, and is moving over the platen roller 5 and through the tension rollers 7*a* and 7*b*. Thus, the perforated stencil 1*a* is protected against wrinkles which might be caused by shrinkage after the thermal perforation process. The foregoing tension is set to be smaller than a pressure with which the stencil 1*a* is sandwiched between the platen roller 5 and the thermal head 6. Therefore, the stencil 1*a* is conveyed at a speed depending upon a peripheral velocity of the platen roller 5.

Referring to FIG. 2, a pair of stencil take-up arms 8*a* and 8*b* are coupled substantially integrally by the linkage 28. The linkage 28 also serves as a protector for isolating the stencil web 2, stencil take-up spool 4, platen roller 5 and tension rollers 7*a* and 7*b* from the cylinder 3*a* of the printing drum 3.

Referring to FIG. 2, a DC motor (not shown) is coupled to the main body 151 via a drive shaft 21*s*. The drive shaft 21*s* has the cam 21 at one end thereof. The cam follower arm 50 is positioned so as to be in contact with the cam 21 via a roller 50*a* at one end thereof.

The cam follower arm 50 is pivotally supported by the main body 151 via a shaft 50*s* at the center thereof. The cam follower arm 50 has the thermal head 6 at the other end thereof. The thermal head 6 extends in parallel to the shaft 5*s* of the platen roller 5. One end of a tension coil spring 51 is hooked on the cam follower arm 50 at a position near the roller 50*a*, and is coupled to the main body 151 at the other end thereof. The tension coil spring 51 urges the thermal head 6 toward the platen roller 5 via the stencil 1. The thermal head 6 is of a well-known structure, i.e. it has an array of minute heat emitting elements in the direction parallel to the platen roller 5, and is connected to a signal line 53 for transmitting digital signals from the original reader 190.

The thermal head moving unit 170 mainly includes the DC motor (not shown), the cam 21, the cam follower 50, a spring 51 and thermal head 6 as described above.

Figure 10:
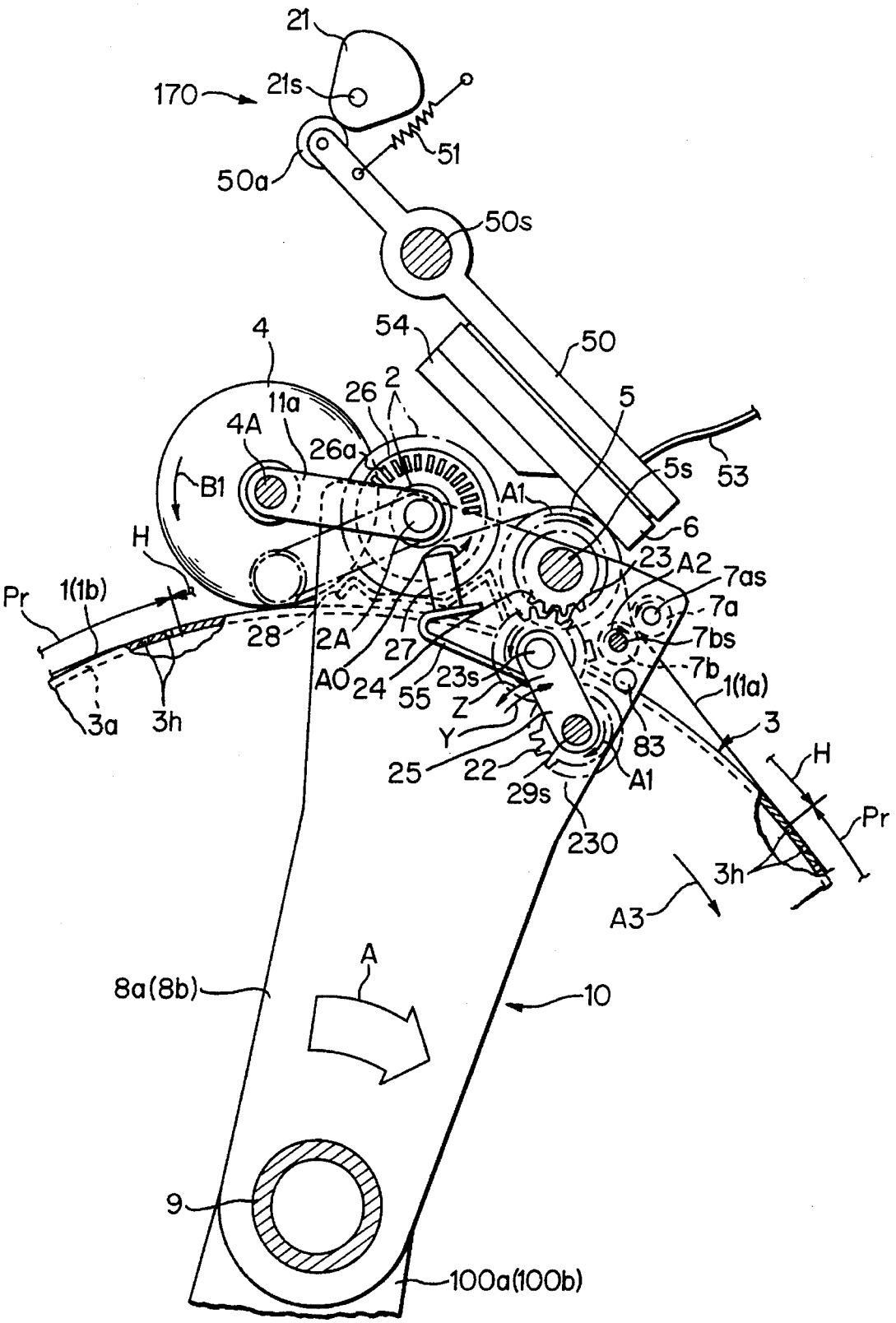
FIG. 10 is a side elevation showing a main part of the stencil duplicating machine in a further embodiment.

The thermal head 6 is substantially integral with the cam follower arm 50 via a thermal head fixing member 54. A photo-interrupter 27 detects a rotation speed of the stencil web 2, and is attached to a bracket 55, which is coupled to the underside of the thermal head fixing member 54 by a screw 56 as shown in FIG. 2, or as attached to the driving mechanism for the platen roller 5 as shown in FIG. 10. The photo-interrupter 27 is a light-transmitting type sensor of a well-known structure, and includes light emitting elements and light receiving elements (not shown). The photo-interrupter 27 is so designed that the light emitting and receiving elements sandwich a slit disc 26, having slit 26*a*, when the thermal head 6 is moved to the stencil making position by the thermal head moving unit 170. The photo-interrupter 27 is connected, via an electric circuit, to a control unit including a micro-computer (not shown). The thinner the stencil web 2, the faster the slitted disc 26 rotates. Therefore, the amount of stencil 1 remaining on the stencil web 2 is detected as follows. Specifically, a variation in cycles of light pulses passing through the slit disc 26, i.e. a variation of cycles of electric pulse signals, is detected by the photo-interrupter 27, and processed by the control unit. When the stencil web 2 becomes empty, the slit disc 26 stops rotating. Thus, the stopping of the slit disc 26 reliably indicates the absence of the stencil 1 on the stencil web 2.

Referring to FIG. 1, the sheet feeding section 200 includes the sheet tray 201 for receiving a stack of sheets P, a pair of separation rollers 202*a* and 202*b* for separating and transmitting sheets P one by one, a pair of register rollers 203*a* and 203*b* for feeding the sheet P in a space between the printing drum 3 and the press roller 20 at a predetermined timing, and a pair of upper and lower guide plates 204*a* and 204*b* for guiding the sheet P from the separation rollers 202*a* and 202*b* to the downstream side of the register rollers 203*a* and 203*b*.

The printed sheet receiving section 210 includes the sheet discharge tray 211 for receiving the printed sheets Pa in succession, a sheet separating claw 212 for separating each printed sheet Pa from the printing drum 3, an endless conveyor belt 215 extending over rollers 213 and 214 to convey the printed sheet Pa toward the sheet discharge tray 211, a fan 216 for attracting the printed sheet Pa onto the conveyor belt 215, and a member 217 for curving the printed sheet Pa before the printed sheet Pa is delivered onto the tray 211.

In operation, a fresh stencil web 2 and an empty stencil take-spool 4 are loaded into the stencil duplicating machine as described below.

Referring to FIGS. 3 and 6, the drum unit 220 is manually withdrawn from the main body 151 in the direction opposite to the direction X. Then, the coupling slide shafts 4B and 2B are slid via the arm 11*b* in the direction L, so that a stencil take-up spool 4 full with used stencils can be removed. A fresh stencil web 2 and an empty stencil take-up spool 4 (i.e. shaft 4*s*) are simultaneously loaded between the stencil feed/take-up arms 8*a* and 8*b* via the stencil web support 2H and the stencil take-up spool support 4H, respectively. Then, a leading edge of the stencil 1 is passed over the platen roller 5 and through the tension rollers 7*a* and 7*b*, is wrapped on the outer surface of the printing drum 3, and is inserted into the slit (not shown) of the shaft 4*s* of the stencil take-up spool 4. During the foregoing process, the stencil feed/take-up unit 10 is put in a static state as shown in FIG. 2 by using a jig (not shown) which is similar to the brake member 240 shown in FIG. 5.

Since the printing drum 3 is disconnected by the one-way clutches 17*a* and 17*b* in this state, the stencil 1 can be easily wrapped on the printing drum 3 by manually turning the printing drum 3 in the direction A3. The predetermined braking force is applied to the coupling shaft 2A and the coupling slide shaft 2B for coupling and supporting the opposite ends of the core 2*s* of the stencil web 2. Therefore, the stencil 1, paid out from the stencil web 2, has the predetermined tension applied thereto, which allows the stencil 1 to be wrapped on the printing drum 3 without being warped or creased.

After completing the initial setting, the drum unit 220 will be loaded back into the main body 151 in the direction X. Specifically, the rollers 71 are inserted into the holding member 72 first of all, and then the drum unit 220 is pushed forward. The leading edge of the center shaft 9 is fitted into the bearing 153 on the side plate 152, and the drum gear 12 is engaged with the drum actuating gear 13 of the driving mechanism 180. Thereafter, the platen roller gear 24 is made to reach a point close to the platen roller driving gear 23 of the platen roller driving mechanism 230. Thus, the drum unit 220 will be completely loaded into the main body 151. In this state, the thermal head 6 supported by the thermal head moving mechanism 170 stays at the non-stencil-perforating position. Further, the press roller 20 assumes a posture with its recessed portion 18 facing upward, so that it does not interfere with the drum unit 220.

The stencil feed/take-up unit 10 is stopped by the brake member 240 at the position as shown in FIG. 2. In other words, when the solenoid 81 is energized, the guide pin 80 fits into the hole 83 of the stencil feed/take-up arm 8*a*, which positions the stencil feed/take-up unit 10 with respect to the main body 151. Conversely, when the solenoid 81 is de-energized, the stencil feed/take-up unit 10 will resume its operation. The operation of the brake member 240 will be omitted in the following description.

Ink is oozed out to the outer surface of the printing drum 3 so that the stencil 1 reliably sticks on the outer surface of the printing drum 3 due to the viscosity of the ink. Referring to FIG. 2, the stencil feed/take-up unit 10 and the printing drum 3 rotate together in the direction A when the rotational force of the drive mechanism 180 is transmitted from the drum actuating gear 13 to the drum gear 12. In this state, the stencil feed/take-up unit 10 remains connected to the printing drum 3 via the one-way clutches 17*a* and 17*b*. Substantially simultaneously with the foregoing operation, the press roller 20 is rotated in the direction B as shown in FIG. 1. The stencil 1 is pressed on the printing drum 3 by the outer surface of the press roller 20. At the same time, the ink supply roller 61 also rotates in the direction A (clockwise), so that ink oozes out to the surface of the printing drum 3, thereby sticking the stencil 1 onto the printing drum 3 due to the viscosity of the ink. The foregoing operation is called "the stencil sticking process".

The stencil sticking process is also carried out when a jammed stencil 1 is reset.

FIG. 1 shows that the stencil 1 sticks on the printing drum 3. The stencil feed/take-up unit 10, which projects from the outer surface of the printing drum 3, rotates in synchronization with the recessed portion 18 of the press roller 20, thereby preventing any interference between them. In this state, print sheets P may be conveyed into the space between the printing drum 3 and the press roller 20 at the predetermined timing, and the stencil 1 may be pressed by the press roller 20 via the print sheet P. Thus, the initial setting of the stencil 1 will be completed.

The stencil duplicating machine carries out its series of printing operations as described below. When the stencil feed/take-up unit 10 assumes the position as shown in FIG. 2, the stencil making and stencil take-up operations are simultaneously performed. Actuation of a stencil making start key (not shown) allows the thermal head moving mechanism 170 to shift the thermal head 6 to the stencil perforating position, i.e. to come into contact with the platen roller 5 via the stencil 1. Specifically, actuation of the DC motor (not shown) rotates the cam 21. The cam follower arm 50 is turned on the shaft 50*s* by the force of the tension coil spring 51, thereby pushing the heat emitting elements of the thermal head 6 toward the platen roller 5 via the stencil 1.

Simultaneously with the foregoing operation, the pulse motor 29 of the platen roller driving mechanism 230 is actuated. The platen roller driving gear 23 turns to engage with the platen roller gear 24, thereby rotating the platen roller 5. Concurrently, the stencil take-up spool 4 is rotated in the direction B1 via the first gear 40, the stencil take-up spool gear 41 and the friction clutch 42. The printing drum 3 follows the rotation of the stencil take-up spool 4, i.e. rotates in the same direction A3, since the printing drum 3 is disconnected from the bearings 10*a* and 10*b* by the one-way clutches 17*a* and 17*b*. In other words, the printing drum 3 is rotatable without the rotational force from the drive unit 140 or load applied by the ink supply unit 160. Thus, it is possible to set a small rotational force for the stencil take-up spool 4 to let the printing drum 3 follow the rotation of the stencil take-up spool 4. This contributes to realization of very precise conveyance of the stencil 1. The sticking stencil 1 will be peeled off from the printing drum 3 and be taken up by the stencil take-up spool 4. Concurrently, when the platen roller 5 is actuated, its rotational force is transmitted to the tension roller 7*b* via the second gear 44, the idler gear (not shown), the tension roller gear 45 and the friction clutch 46, so that the tension roller 7*b* is rotated, followed by the tension roller 7*a*. In synchronization with the conveyance of the stencil 1 in response to the actuation of the platen roller 5, image signals read and processed by the original reader 190 are provided to the thermal head 6, which perforates patterns of the original image on the stencil 1 by selectively actuating minute heating elements. The perforated stencil 1*a* is made tense by the force applied by the friction clutch 46 so as to be substantially free from creases.

The stencil take-up spool 4 is continuously in contact with the outer surface of the printing drum 3 with the predetermined pressure exerted by the torsion coil spring (not shown) between the coupling shafts 2A and 2B and the arms 11*a* and 11*b*. Therefore, even when the stencil take-up spool 4 becomes thicker with the used stencil 1*b*, the perforated stencil la is not raised from the printing drum 3, and is peeled off at the predetermined position of the printing drum 3. Since the stencil take-up spool 4 is rotated in the direction B1 via the friction clutch 42, and the rotational force of the platen roller driving mechanism 230 is transmitted to the platen roller 5, the stencil 1*b* sticking onto the printing drum 3 is made tense by the force of the friction clutch 42.

The thicker the stencil take-up spool 4 takes up used stencils 1*b*, the more variable the rotation speed of the stencil take-up spool 4. However, the used stencil taking-up speed is controlled by the friction clutch 42 so as to be equal to the stencil feeding speed of the platen roller 5. Therefore, the stencil 1 is reliably conveyed over the platen roller 5.

During the printing process, the printing drum 3 is reliably operated by the drive force supplied by the driving mechanism which is on the main body 151. Therefore, the printing can be performed with the predetermined tension applied to the stencil 1*a*, which prevents the stencil 1*a* from being broken, and assures production of good printed images. Further, during the stencil taking-up and making processes, the printing drum 3 can be smoothly rotatable without receiving any rotational force from the driving mechanism on the main body or the ink supply unit. Thus, the stencil 1 can be paid out in a reliable manner.

After the completion of the stencil taking-up and making processes, the thermal head 6 comes away from the platen roller 5 because of the operation of the thermal head moving mechanism 170, i.e. the cam 21 is further rotated by the rotational force from the DC motor (not shown) to come into contact with the roller 50*a* at a large diameter portion thereof, and the cam follower arm 50 rotates around the shaft 50*s* against the force of the tension coil spring 51. Then, the stencil feed/take-up unit 10 is released from the brake member 240. Referring to FIGS. 1 and 3, the rotational force of the driving mechanism 180 is transmitted to the drum gear 12 via the drum actuating gear 13, and further to the printing drum 3 via the one-way clutches 17*a* and 17*b*. Thus, the stencil feed/take-up unit 10 and the printing drum 3 rotate in unison in the direction A.

When the printing process is started, sheets P on the sheet tray 201 are separated one by one by the separation rollers 202*a* and 202*b*, are guided by the guide plates 204*a* and 204*b*, and are conveyed toward the register rollers 203*a* and 203*b*. The register rollers 203*a* and 203*b* feed the sheets P into the space between the printing drum 3 and the press roller 20 in synchronization with the rotation of the printing drum 3. Then, the sheet P is pressed to the stencil 1*a* wrapped on the printing drum 3, so that the image of the original is transferred onto a surface of the sheet P via the pores on the stencil 1*a*.

During the printing process, the ink supply roller 61 rotates with the printing drum 3 in the same direction, thereby supplying ink to the inner surface of the printing drum 3. The printed sheet Pa leaves from the press roller 20, is separated from the printing drum 3 by a sheet separating claw 212, attracted by a fan 216, conveyed on the endless belt 215 between the rollers 213 and 214, strained by the member 217, and finally discharged onto the tray 211. The foregoing process is repeated for all the printed sheets Pa. The succeeding stencil making and taking-up processes are started in the state as shown in FIG. 2, and repeated in the same manner.

Figure 8A:
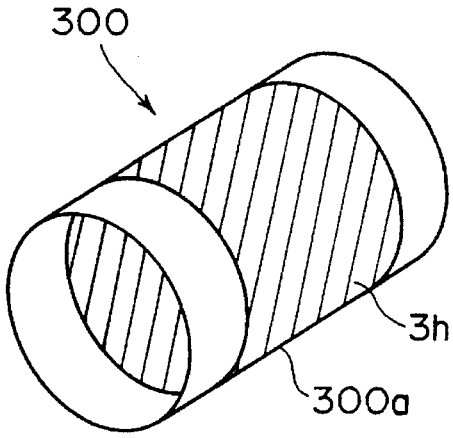
FIG. 8(*a*) is a perspective view of a drum in the preferred embodiment.
Figure 8B:
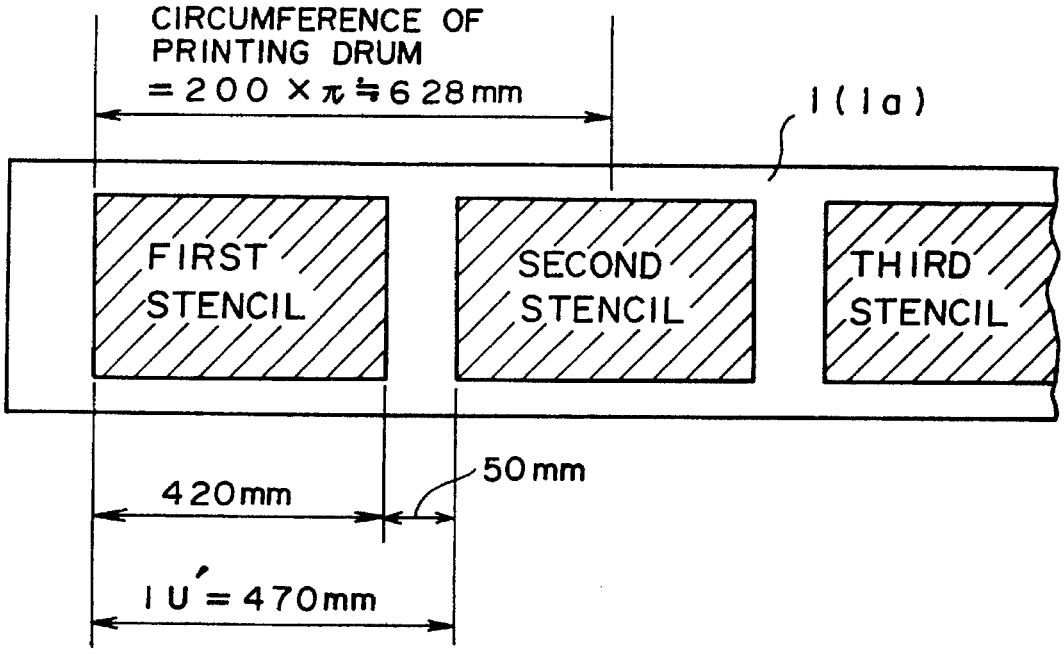

FIGS. 8(a) and 8(b) show a modification of the foregoing embodiment. This modified example differs from the foregoing embodiment in that the printing drum 300 includes a cylinder 300*a* which is porous except for at side edges thereof as shown in FIG. 8(a).

It is assumed here that an original image of A3-size is perforated on a stencil 1 and is printed by using the stencil duplicating machine of the preferred embodiment and by the modified stencil duplicating machine. When the printing drums 3 and 300 have a 200 mm diameter, their circumference is approximately 628 mm (200 mm×π).

Figure 7A:
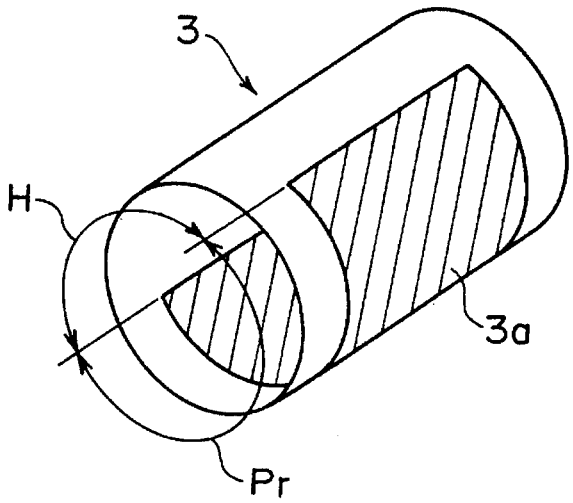
FIG. 7(*a*) is a perspective view of a printing drum used in a modified example.
Figure 7B:
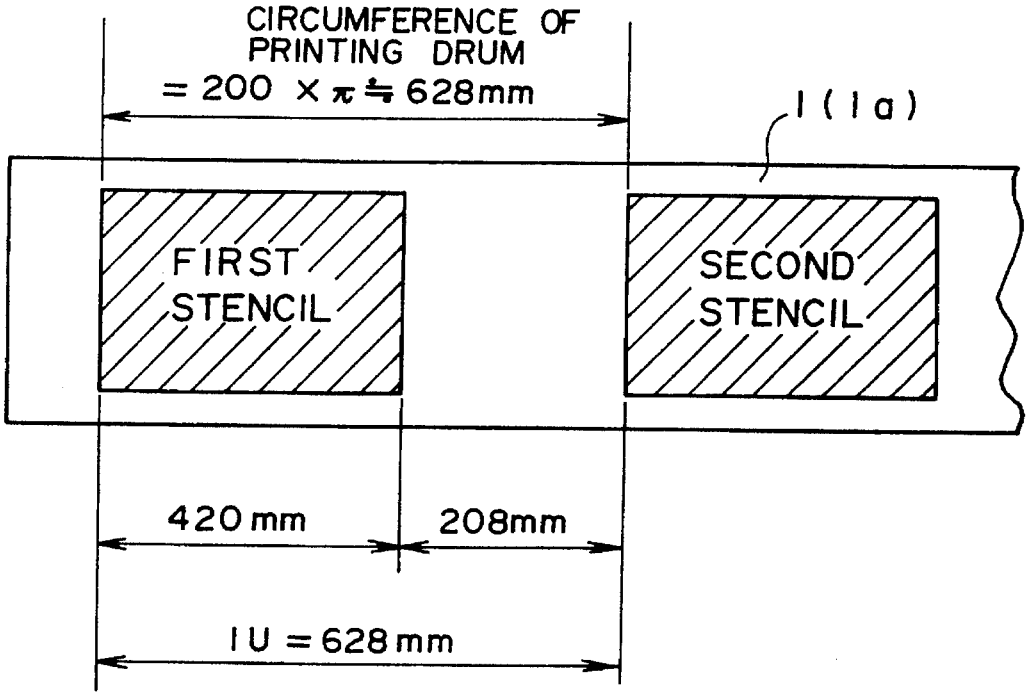

When the printing drum 3 shown in FIG. 7(a) is used, a length 1U of each stencil which is paid out from the stencil web 2 for one stencil taking-up-and-making process is 628 mm, and is equal to the circumference of the printing drum 3 (see FIG. 7(b)). This is because the length 1U of each stencil 1 is equal to 420mm, which is the longer side of the A3 size original, plus blank areas preceding and succeeding the image bearing area of the stencil 1.

Conversely, when the printing drum 300 shown in FIG. 8(a) in the modified embodiment is used, the length 1U' of each stencil 1 bearing the original image is 470 mm, i.e. 420 mm, which is equal to the longer side of the size A3 original, and 50 mm of the blank areas before and after the stencil 1 bearing the original image. Thus, 628 mm−470 mm=158 mm. In the modified example, 158 mm of the stencil length can be saved.

In the modified example, the printing process can be started at any position (phase) of the printing drum 300 relative to the stencil feed/take-up unit 10. Specifically, the length 1U' of the stencil per original image is the effective print length of the original image plus the preceding and succeeding blank areas as allowance. Since it is not necessary to feed the stencil 1 to the length equal to the circumference of the printing drum 300 (i.e. corresponding to one rotation thereof), an amount of the stencil 1 can be saved. Further, since the stencil 1 for each original image is short, the printing process can be started a relatively short period of time after the actuation of the stencil making key.

Figure 9:
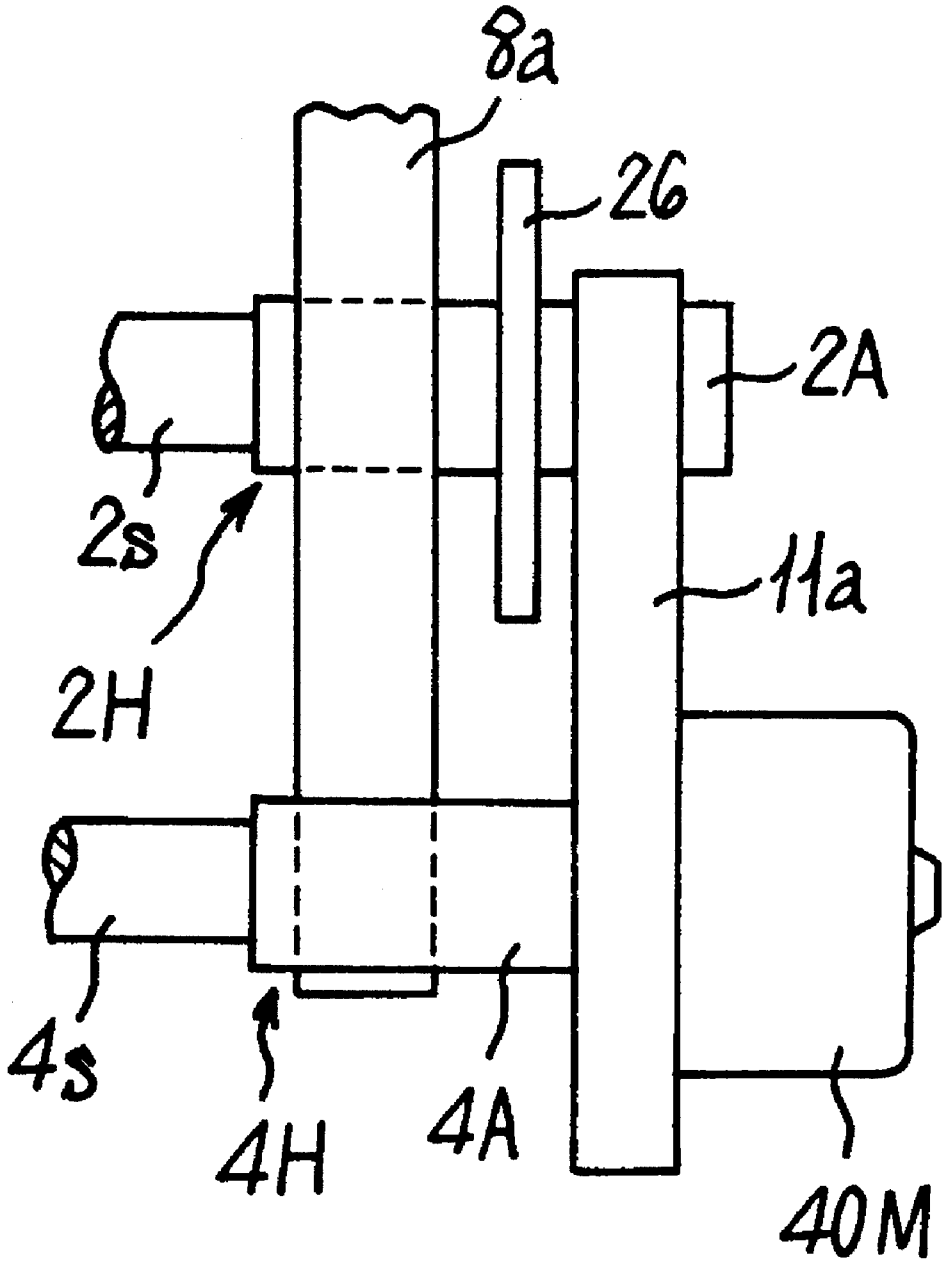
FIG. 9 is an enlarged plan view showing a member for rotating the stencil take-up spool in another modified example.

FIG. 9 shows a still further modified example of the invention. In this example, the first gear 40, stencil take-up spool gear 41 and friction clutch 42 shown in FIG. 4 are dispensed with. Alternatively, a DC motor 40M is used to selectively drive the stencil take-up spool 4, thereby applying the predetermined tension to the stencil 1 which exists between the stencil take-up spool 4 and the platen roller 5.

Referring to FIG. 9, the DC motor 40M has its output shaft connected to the coupling shaft 4A. When no load is applied, the DC motor 40M is controlled to rotate the stencil take-up spool 4 at the peripheral velocity which is faster than the peripheral velocity of the platen roller 5.

Although the stencil take-up spool 4 becomes thicker with used stencils **1*b*, each next used stencil 1*b* is peeled off from the printing drum 3 with the predetermined tension applied thereto by the actuation of the DC motor 40M. In this modified example, the used stencil 1*b* is taken up onto the stencil take-up spool 4 at a speed which is the same as that of the platen roller 5. Therefore, the stencil 1** can be fed out without being creased or stretched.

The friction clutches 42 and 46 serve as the torque limiting units for the stencil take-up spool 4 and tension rollers **7*a* and 7*b*. Alternatively, any units such as brakes using powder or viscous oil which can produce a constant brake force can be used to transmit the rotational force of the platen roller driving mechanism 230**.

To tense the stencil 1 or the stencil **1*a* bearing the original image pattern between the platen roller 5 and tension rollers 7*a* and 7*b*, the peripheral velocity of the tension rollers 7*a* and 7*b* may be set to be faster than that of the platen roller 5. In this case, at least one of the tension rollers 7*a* and 7*b* is made of an elastic material such as sponge, so that the predetermined tension is applied to the stencil 1 or the stencil 1*a* due to sliding and frictional forces produced between the stencil 1 or 1*a* and the tension rollers 7*a* and 7*b*. Further, the tension rollers 7*a* and 7*b*** are reliably rotated by the rotational forces transmitted by a drive mechanism such as a gear train.

The photo-interrupter 27 for detecting the rotational speeds of the stencil web 2 and the stencil take-up spool 4 may be disposed on the platen roller driving mechanism 230. The photo-interrupter 27 moves to the slit disc 26 with the platen roller driving mechanism.

The stencil 1 is 7 μm thick in the foregoing embodiment, but a stencil of between 2 μm and 10 μm in thickness can also be used in a preferable manner. Although the stencil 1 is made substantially only of the thermoplastic resin film in the foregoing embodiment, a conventional stencil (approximately 45 μm to 50 μm thick) including a porous support material such as Japanese paper may be also used for the stencil duplicating machine of the invention. In such a case, an amount of the stencil on a stencil web will be reduced.

In the foregoing embodiment, the stencil sticking process is performed after a fresh stencil web 2 is loaded or a jammed stencil is removed. The stencil sticking process is not always necessary. This process is not required so long as the outer surface of the printing drum 3 or 300 is wet with a necessary amount of ink.

The stencil web may be independently and rotatably supported on a separate support in place of the stencil web support 2H. Alternatively, the stencil web support 2H may be coupled to the stencil web 2, and structured to be rotatable with the stencil web 2. Such a stencil web support is required at least to be structured so as to apply a predetermined brake force to the stencil 1 paid out from the stencil web 2.

The stencil take-up spool 4 may be independently and rotatably supported by a separate support in place of the stencil take-up spool support 4H. Alternatively, the stencil take-up support 4H may be coupled to the stencil take-up spool 4, and structured to be rotatable with the stencil take-up spool 4.

Further, the platen roller drive mechanism 230 shown in FIGS. 2 and 3 may be replaced with any mechanism whose function is similar to the mechanism 230. Such a mechanism is connected to and disconnected from the tension roller gear 45 so as to rotate the tension rollers **7*a* and 7*b*, and make the platen roller 5 follow the tension rollers 7*a* and 7*b*. In such a case, the stencil 1 might be conveyed via the platen roller 5** somewhat unreliably.

What is claimed is:

1. A stencil duplicating machine comprising:

(a) a printing drum having a drum axis and for supporting on an outer circumferential surface thereof a thermal perforation type stencil and being rotatable around the drum axis with the stencil wound thereon;

(b) an ink supply for supplying ink to an inner circumferential surface of the printing drum;

(c) stencil web support means for supporting a stencil web from which the stencil is paid out to the printing drum;

(d) stencil take-up spool support means for supporting a stencil take-up spool around which the stencil is taken up from the printing drum;

(e) a platen roller for conveying the stencil paid out from the stencil web, the platen roller being located near the stencil web support means;

(f) a thermal head supported by a main body, the thermal head being movable between a stencil-making position, where it is in contact with the platen roller via the stencil during a stencil making process, and a non-stencil-making position, where it is positioned away from the platen roller;

(g) a thermal head moving mechanism for selectively moving the thermal head between the stencil-making position and the non-stencil-making position;

(h) a stencil feed/take-up unit for supporting the stencil web support means, the stencil take-up spool support means and the platen roller;

(i) connecting means for connecting the stencil feed/take-up unit to the printing drum such that the stencil feed/take-up unit may be freely rotatable around the drum axis of the printing drum;

(j) a driving mechanism for rotating the printing drum and the stencil feed/take-up unit around the drum axis;

(k) brake means for stopping the stencil feed/take-up unit at a position corresponding to the stencil-making position with respect to the main body during the stencil take-up and making processes;

(l) a platen roller driving mechanism for selectively driving the platen roller; and (m) torque limiting means for transmitting a rotational force of the platen roller to the stencil take-up spool.

2. A stencil duplicating machine comprising:

(a) a printing drum having a drum axis and including a cylindrical member having ink-oozing pores over an entire surface except side edges thereof, the printing drum supporting a thermal perforating type stencil thereon and being rotatable around the drum axis with the stencil wound thereon;

(b) an ink supply for supplying ink to an inner circumferential surface of the printing drum;

(c) stencil web support means for supporting a stencil web from which the stencil is paid out to the printing drum;

(d) stencil take-up spool support means for supporting a stencil take-up spool around which the stencil is taken up from the printing drum;

(e) a platen roller for conveying the stencil paid out from the stencil web, the platen roller being located near the stencil web support means;

(f) a stencil feed/take-up unit for supporting the stencil web support means, the stencil take-up spool support means and the platen roller;

(g) a thermal head supported by a main body, the thermal head being movable between a stencil-making position, where the stencil feed/take-up unit stays to feed the stencil and where the thermal head is in contact with the platen roller via the stencil during a stencil making process, and a non-stencil-making position, where the thermal head is positioned away from the platen roller;

(h) a thermal head moving mechanism for selectively moving the thermal head between the stencil-making position and the non-stencil-making position;

(i) connecting means for connecting the stencil feed/take-up unit to the printing drum such that the stencil feed/take-up unit may be freely rotatable around the drum axis of the printing drum and may be movable to a stencil feeding position; and (j) a driving mechanism for rotating the printing drum and/or the stencil feed/take-up unit around the drum axis.

3. A stencil duplicating machine as in claim 1 or 2, further including tension rollers disposed downstream of the platen roller in a stencil feeding direction and torque limiting means for transmitting a rotational force of the platen roller to the tension rollers so that predetermined tension is applied to the stencil between the platen roller and the tension rollers.

4. A stencil duplicating machine as in claim 1 or 2, further including tension rollers disposed downstream of the platen roller in a stencil feeding direction, and further comprising:

means for controlling the tension rollers such that a peripheral velocity of the tension rollers is set to be faster than a peripheral velocity of the platen roller so as to apply predetermined tension to the stencil between the platen roller and the tension rollers.

5. A stencil duplicating machine as in claim 1 or 2, further including means for detecting a rotational speed of the stencil web, the detecting means being moved in synchronization of movement of the thermal head toward the platen roller by the thermal head moving mechanism, and detecting the rotational speed of the stencil web in response to conveyance of the stencil by the platen roller so as to detect the amount of the stencil remaining on the stencil web.

6. A stencil duplicating machine as in claim 1 or 2, wherein the driving mechanism is attached to the main body, and the connecting means includes one-way clutches which are connectable in a direction to transmit a rotational force from the stencil feed/take-up unit to the printing drum during a printing process, are disconnectable so as to permit the printing drum to follow the rotation of the stencil feed/take-up spool during stencil taking-up and making processes, and are interposed between the stencil feed/take-up unit and the printing drum.

7. A stencil duplicating machine as in claim 2, further including brake means for stopping the stencil feed/take-up unit at a position corresponding to the stencil making position with respect to the main body during the stencil taking-up and making processes, a platen roller driving mechanism for selectively driving the platen roller, and torque limiting means for transmitting a rotational force of the platen roller to the stencil take-up spool.

8. A stencil duplicating machine as in claim 1 or 7, further including means for detecting a rotational speed of the stencil web, the detecting means being moved in synchronization of movement of the platen roller driving mechanism toward the platen roller, and detecting the rotational speed of the stencil web in response to conveyance of the stencil by the platen roller so as to detect the amount of the stencil remaining on the stencil web, wherein the platen roller driving mechanism is disposed on the main body.

9. A stencil duplicating machine comprising:

(a) a printing drum having a drum axis and for supporting on an outer circumferential surface thereof a thermal perforation type stencil and being rotatable around the drum axis with the stencil wound thereon;

(b) an ink supply for supplying ink to an inner circumferential surface of the printing drum;

(c) stencil web support means for supporting a stencil web from which the stencil is paid out to the printing drum;

(d) stencil take-up spool support means for supporting a stencil take-up spool around which the stencil is taken up from the printing drum;

(e) a platen roller for conveying the stencil paid out from the stencil web, the platen roller being located near the stencil web support means;

(f) a thermal head supported by a main body which is stationary relative to the printing drum, the thermal head being movable between a stencil-making position, where it is in contact with the platen roller via the stencil during a stencil making process, and a non-stencil-making position, where it is positioned away from the platen roller;

(g) a thermal head moving mechanism for selectively moving the thermal head between the stencil-making position and the non-stencil-making position;

(h) a single integral stencil feed/take-up unit for supporting the stencil web support means, the stencil take-up spool support means and the platen roller;

(i) connecting means for connecting the stencil feed/take-up unit to the printing drum such that the stencil feed/take-up unit may be freely rotatable around the drum axis of the printing drum;

(j) a driving mechanism for rotating the printing drum and/or the stencil feed/take-up unit around the drum axis;

(k) brake means for stopping the stencil feed/take-up unit at a position corresponding to the stencil-making position with respect to the main body during the stencil take-up and making processes;

(l) a platen roller driving mechanism for selectively driving the platen roller; and (m) rotating means for selectively rotating the stencil take-up spool.

10. A stencil duplicating machine comprising:

(a) a printing drum having a drum axis and including a cylindrical member having ink-oozing pores over an entire surface except side edges thereof, the printing drum supporting a thermal perforating type stencil thereon and being rotatable around the drum axis with the stencil wound thereon;

(b) an ink supply for supplying ink to an inner circumferential surface of the printing drum;

(c) stencil web support means for supporting a stencil web from which the stencil is paid out to the printing drum;

(d) stencil take-up spool support means for supporting a stencil take-up spool around which the stencil is taken up from the printing drum;

(e) a platen roller for conveying the stencil paid out from the stencil web, the platen roller being located near the stencil web support means;

(f) a stencil feed/take-up unit for supporting the stencil web support means, the stencil take-up spool support means and the platen roller;

(g) a thermal head supported by a main body, the thermal head being movable between a stencil-making position, where the stencil feed/take-up unit stays to feed the stencil and where the thermal head is in contact with the platen roller via the stencil during a stencil making process, and a non-stencil-making position, where the thermal head is positioned away from the platen roller;

(h) a thermal head moving mechanism for selectively moving the thermal head between the stencil-making position and the non-stencil-making position;

(i) connecting means for connecting the stencil feed/take-up unit to the printing drum such that the stencil feed/take-up unit may be freely rotatable around the drum axis of the printing drum and may be movable to a stencil feeding position;

(j) a driving mechanism for rotating the printing drum or the stencil feed/take-up unit around the drum axis;

(k) brake means for stopping the stencil feed/take-up unit at a position corresponding to the stencil making position with respect to the main body during the stencil taking-up and making processes;

(l) a platen roller driving mechanism for selectively driving the platen roller; and (m) rotating means for selectively rotating the stencil take-up spool.

* * * * *